US006146037A

United States Patent [19]

Schuh et al.

[11] Patent Number: 6,146,037

[45] Date of Patent: Nov. 14, 2000

[54] METHOD FOR INDICATING PRINTER STATUS

[75] Inventors: Eric S. Schuh, Portland, Oreg.; Corlene M. Ankrum, Vancouver, Wash.; Donald R. Bloyer, Brush Prairie, Wash.; Daniel R. Dwyer, Battle Ground, Wash.

[73] Assignee: Hewlett-Packard Company, Palo Alto, Calif.

[21] Appl. No.: 09/379,705

[22] Filed: Aug. 24, 1999

[51] Int. Cl.[7] ..... B41J 29/18

[52] U.S. Cl. ..... 400/703; 400/582

[58] Field of Search ..... 400/703, 582, 400/202, 202.1, 279

[56] References Cited

U.S. PATENT DOCUMENTS

| | | | |
|---|---|---|---|
| 5,049,898 | 9/1991 | Arthur et al. | 346/1.1 |
| 5,297,880 | 3/1994 | Kawanishi et al. | 400/320 |
| 5,842,800 | 12/1998 | Bailey et al. | 400/703 |

OTHER PUBLICATIONS

Hewlett–Packard Company, "HP Desk Jet 310 Printer", Aug. 1993, pp. 1–12.

*Primary Examiner*—John S. Hilten
*Assistant Examiner*—Darius N. Cone

[57] ABSTRACT

A method and apparatus for indicating the condition of a printer is provided. In an inkjet printer having at least one pen that is mounted in a carriage that moves back and forth across the media, the printer status is determined by a controller in the printer which communicates with the pen. The carriage containing the pens is used as a pointer and has is set to a desired carriage position to point to a selected icon from a set of icons located on a top surface adjacent to the carriage. Each of the icons indicates a printer status such as low ink level or a pen problem. The carriage and the set of icons may be located under a lid. When the user lifts the lid such as in response to a print cartridge status light that is illuminated on the control panel, the carriage is set to the desired carriage position to indicate the appropriate printer status. The icons are chosen in such a manner as to be universally understandable and with no need for localization to a particular market.

11 Claims, 5 Drawing Sheets

METHOD FOR INDICATING PRINTER STATUS

BACKGROUND OF THE INVENTION

This invention relates generally to computer printers and in particular to a method for visually indicating the printer status.

Printers for personal computers such as the Hewlett-Packard DeskJet® family of printers typically contain a carriage that moves back and forth across a sheet of paper ("media") during the printing operation. The carriage contains one or more printer cartridges ("pens") that apply ink to the media to form the printed image. The carriage side to side positioning is along a set of coordinates arbitrarily defined as the x axis while the media direction through the printer is considered the y axis.

Following the introduction of color printing, it is now common to find two or more pens on the carriage. In most cases, a black pen, containing a black pigment based ink, and a three color pen, containing the complementary colors of cyan, magenta, and yellow, are used. Separate color pens for the cyan, magenta, and yellow colors may also be used. The black pen is optimized for high contrast monochrome printing such as the printing of text while the color pen is used to print color images. In most cases, the color pen and the black pen have their own ink supply. Alternatively, the ink supply may be located in a separate ink reservoir and supplied to the pens via flexible tubing in a technology referred to as "off axis printing".

The black pen and the color pen each contain complex circuitry typically in the form of an integrated circuit which operates to receive image data from the printer as the carriage travels along the x axis and apply ink to the media from a set of nozzles responsive to the image data. Each of the pens in turn communicates back to the controller in the printer with status information such as ink supply and pen functionality. The controller also verifies that the type of pen is properly matched to the particular model of printer. The pens are therefore a major component of the printer which direct affect print quality and require user attention for maintenance or replacement. Printer status is a collection of information about the present state of the printer and typically includes ink supply and pen functionality. It would be desirable to provide a user friendly method for indicating printer status which does not add substantial manufacturing cost to the printer.

In order for the printer to function properly, all of the pens must have an adequate supply of ink, must be properly matched to the printer type, and must otherwise be functional. If any of these conditions are not met, the user is left to troubleshoot the printer and determine what the problem is. Prior art inkjet printers such as the HP Deskjet® 895 printer have a single LED (light emitting diode) indicator on the printer control panel that lights to indicate that there is an inadequate supply of ink in one of the pens but does not indicate which pen is affected. It would be desirable to provide a method for indicating printer status in greater detail that is visual and intuitive.

It was discovered that the carriage of an inkjet printer could be used to indicate the printer settings. In the HP Deskjet® 310 printer, a printer settings menu having selections for the character set, text scaling, perforation skip, media source, and so on is located adjacent to the carriage. A pointer on the carriage is used to point to a particular setting by moving the carriage to a selected position along the x axis. However, this method addresses only a setup mode for static printer setup parameters and does not provide for the indication of current printer status. However, merely indicating printer settings which were originally set by the user is not by itself useful for communicating the printer status in order to facilitate troubleshooting and correcting problems.

Therefore, it would be desirable to provide a method for indicating the condition of the pens using the carriage to visually point to a set of condition indicators.

SUMMARY OF THE INVENTION

In accordance with the present invention, a method and apparatus for indicating the condition of a printer is provided. In an inkjet printer having at least one pen which is mounted in a carriage that moves back and forth across the media, the printer status is determined by a controller in the printer which communicates with the pen. Ink supply has been found to a critical parameter since a pen running out of ink is the most common problem that must be corrected by the user. Other pen problems such as a missing pen, an improperly installed pen or a defective pen can be grouped as a second parameter that would benefit from another set of indicators. Since most printers now contain multiple pens, typically a black pen and at least one color pen, the problem of identifying which pen is having a problem becomes more important making it desirable to provide an indication of which pen is experiencing the problem. Finally, if all of the pens are operational, a separate indication for a normal printer status with no problems detected is provided.

The carriage containing the pens is used as a pointer and is set to a desired carriage position to point to a selected icon from a set of icons located on a top surface adjacent to the carriage. Each of the icons represents a printer status such as low ink level or a pen problem. The carriage and the set of icons may be located under a lid. When the user lifts the lid such as in response to a print cartridge status light that is illuminated on the control panel, the carriage is set to the desired carriage position to indicate the appropriate printer status. The icons are chosen in such a manner as to be universally understandable and with no need for localization to a particular market.

One feature of the present invention is to provide a method for visually indicating the printer condition.

Another feature of the present invention is to provide a method for visually indicating the printer condition using the carriage as a pointing device.

A further feature of the present invention is to provide a method for indicating printer condition with reduced component count and cost.

An additional feature of the present invention is to provide a printer which indicates pen status using a series of icons which are pointed to by the carriage.

Other features, attainments, and advantages will become apparent to those skilled in the art upon a reading of the following description when taken in conjunction with the accompanying drawings.

DETAILED DESCRIPTION OF THE INVENTION

Figure 1:
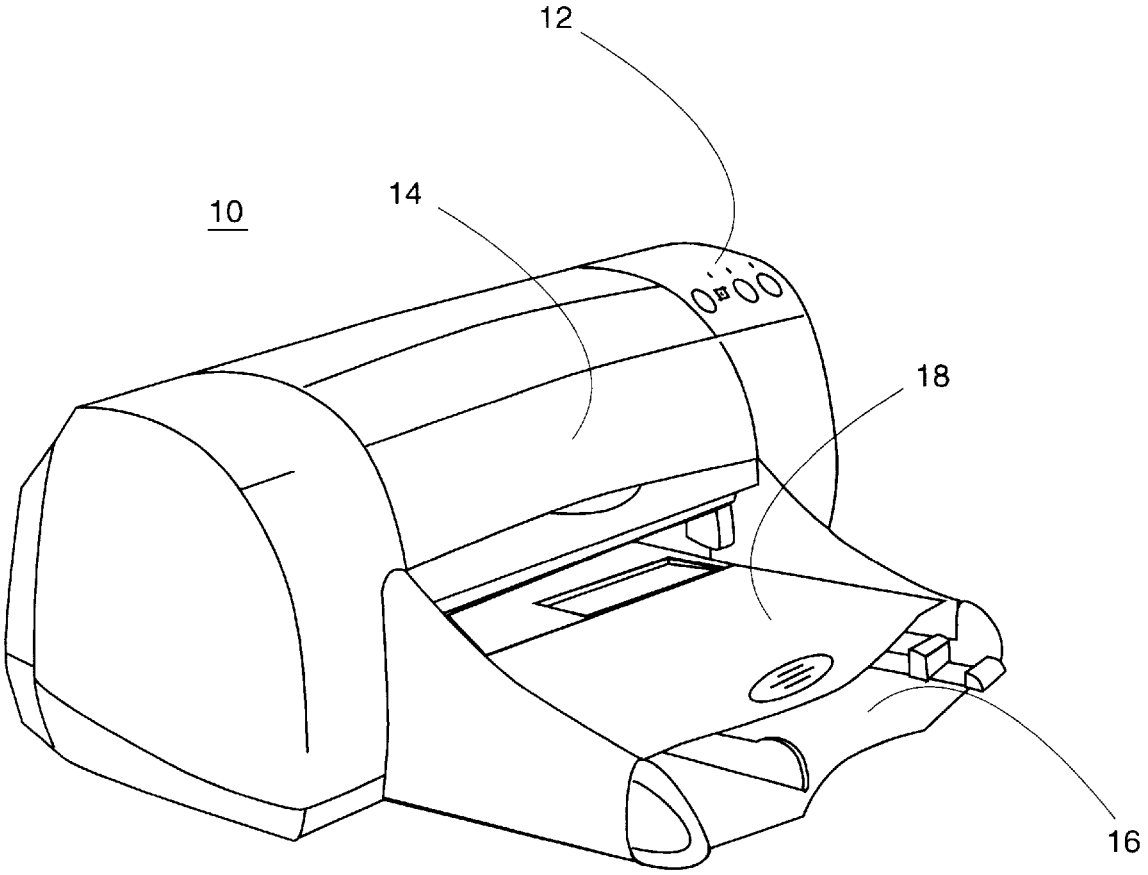
FIG. 1 is an illustration of a printer according to the present invention with the lid closed.

In FIG. 1, there is shown a printer 10 having a control panel 12 and a lid 14. The lid 14 is shown in a closed position. A paper tray 16 holds new sheets of media such as paper (not shown) which are fed into the printer 10. An output tray 18 holds the sheets of printed media (not shown) which are produced by the printer 10. During normal operation of the printer 10, the lid 14 remains in the closed position to protect the user from the moving parts underneath. The control panel 12 provides for normal printer control functions such as power on/off, resume, and cancel print job.

Figure 2:
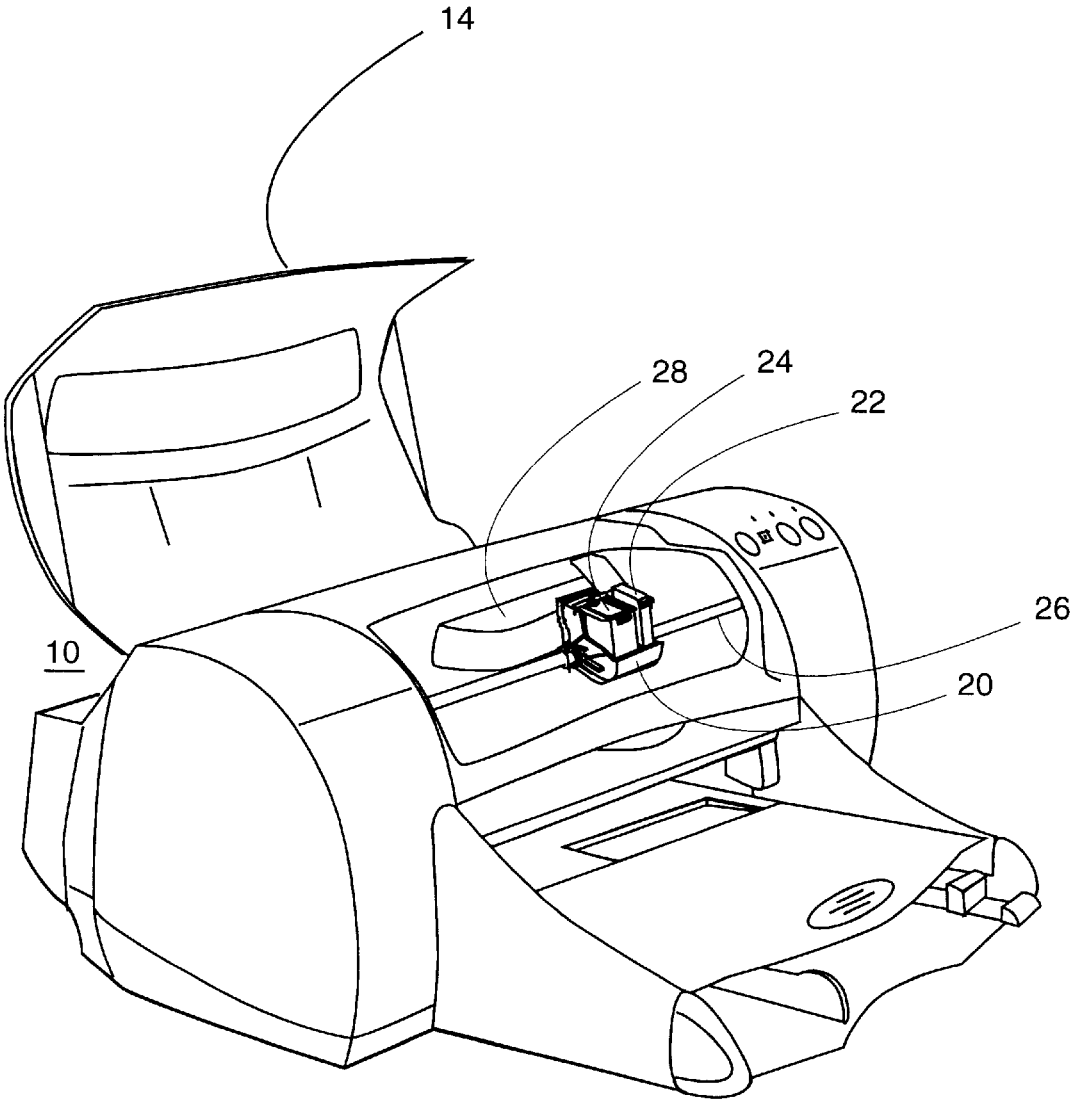
FIG. 2 is an illustration of the printer of FIG. 1 with the lid open to reveal the carriage.

In FIG. 2, the lid 14 of the printer 10 is in an open position to reveal a carriage 20 holding a black pen 22 and a color pen 24. The carriage 20 moves back and forth along a guide rod 26. A ribbon cable 28 provides for the electrical connections between the printer 10 and the black pen 22 and the color pen 24.

With the lid 14 in the open position, the printer 10 is in a service position with the carriage 20 placed in a static position along the guide rod 26. When the lid 14 is raised in prior art printers, the carriage 20 is typically placed in the center of its length of travel rather than on one side or the other to allow for easy access to the black pen 22 and the color pen 24. In the present invention, the carriage 20 is positioned as a visual pointer to indicate the printer status while still allowing access to install or change the black pen 22 and the color pen 24 as explained in more detail below.

Figure 3:
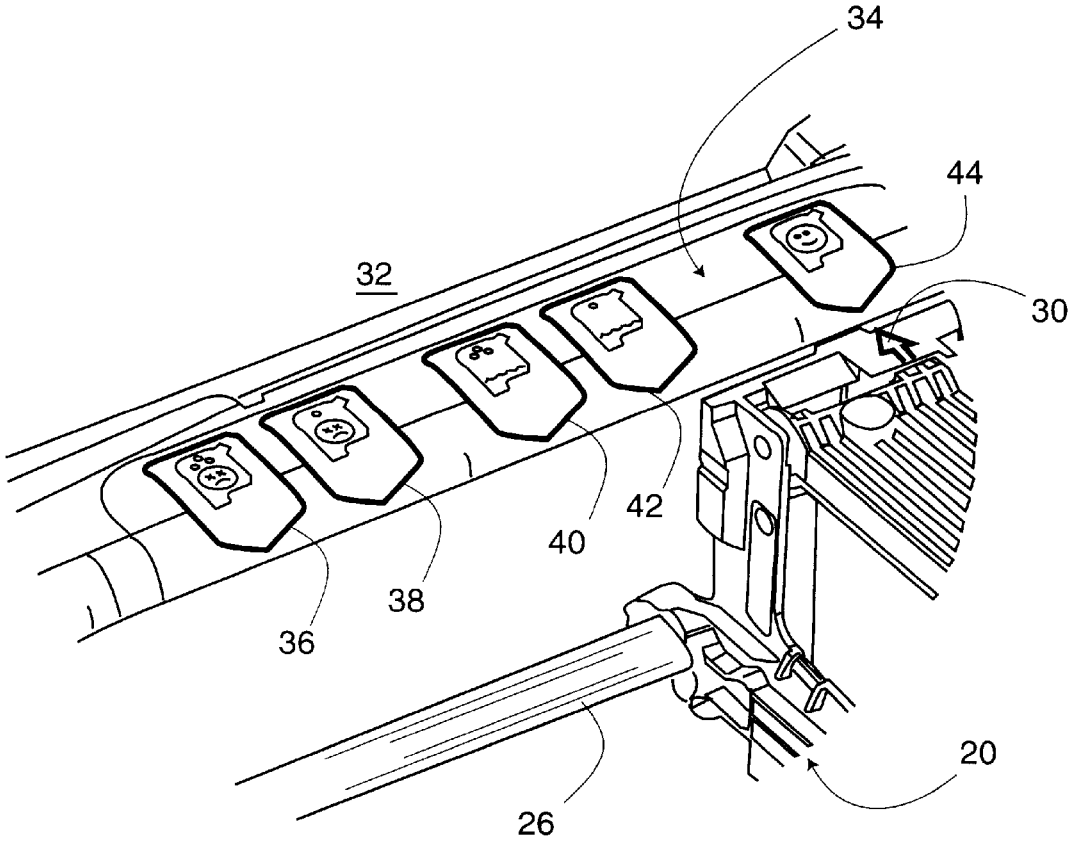
FIG. 3 is an illustration of a portion of the printer of FIG. 2 with the carriage and icons on the top surface.

In FIG. 3, there is shown a portion of the carriage 20 and guide rod 26. An arrow 30 is used to point to one of a set of icons 32 located on a top surface 34 of the printer 10. The top surface 34 may be located underneath the lid 14 in the closed position. The set of icons 32 includes icons 36–44 that are status indicators that each visually indicate a particular printer status of the printer 10. As shown, the carriage 20 and arrow 30 are positioned to point at the icon 44 that corresponds to a printer status that all of the pens have a sufficient ink supply and are functional.

The set of icons 32 are preferably a set of universally understandable graphics that require no localization for different markets around the world and do not depend on any particular language or culture for their meaning to be understood. The "unhappy face" of the icons 36 and 38 stand universally for problems with the pens while a low ink level is indicated by the liquid symbol of icons 40 and 42. The "happy face" is universally associated with no problems. The three dots of icons 36 and 40 are associated with the color pen 24 while the single dot of icons 38 and 42 are associated with the black pen 22. The set of icons 32 thus provides the printer status for each of the black pen 22 and the color pen 24. Other forms of iconization are possible to fully indicate other printer status conditions or to handle additional numbers of pens such as in the case of separate pens for the cyan, magenta, and yellow colors.

With no localization needed, the set of icons 32 may simply be molded onto the top surface 34 of the printer 10. Because the set of icons 32 and the arrow 30 can be molded as part of the existing components of the printer 10, there are no additional components that need to be added, thereby saving component cost and manufacturing complexity. Alternatively, the set of icons 32 may be in the form of adhesive labels that are applied to the top surface 34 or simply printed on the top surface 34 with ink or paint. Localized versions of text and numerals can be added as necessary and still realize the benefits of the present invention.

Figure 4:
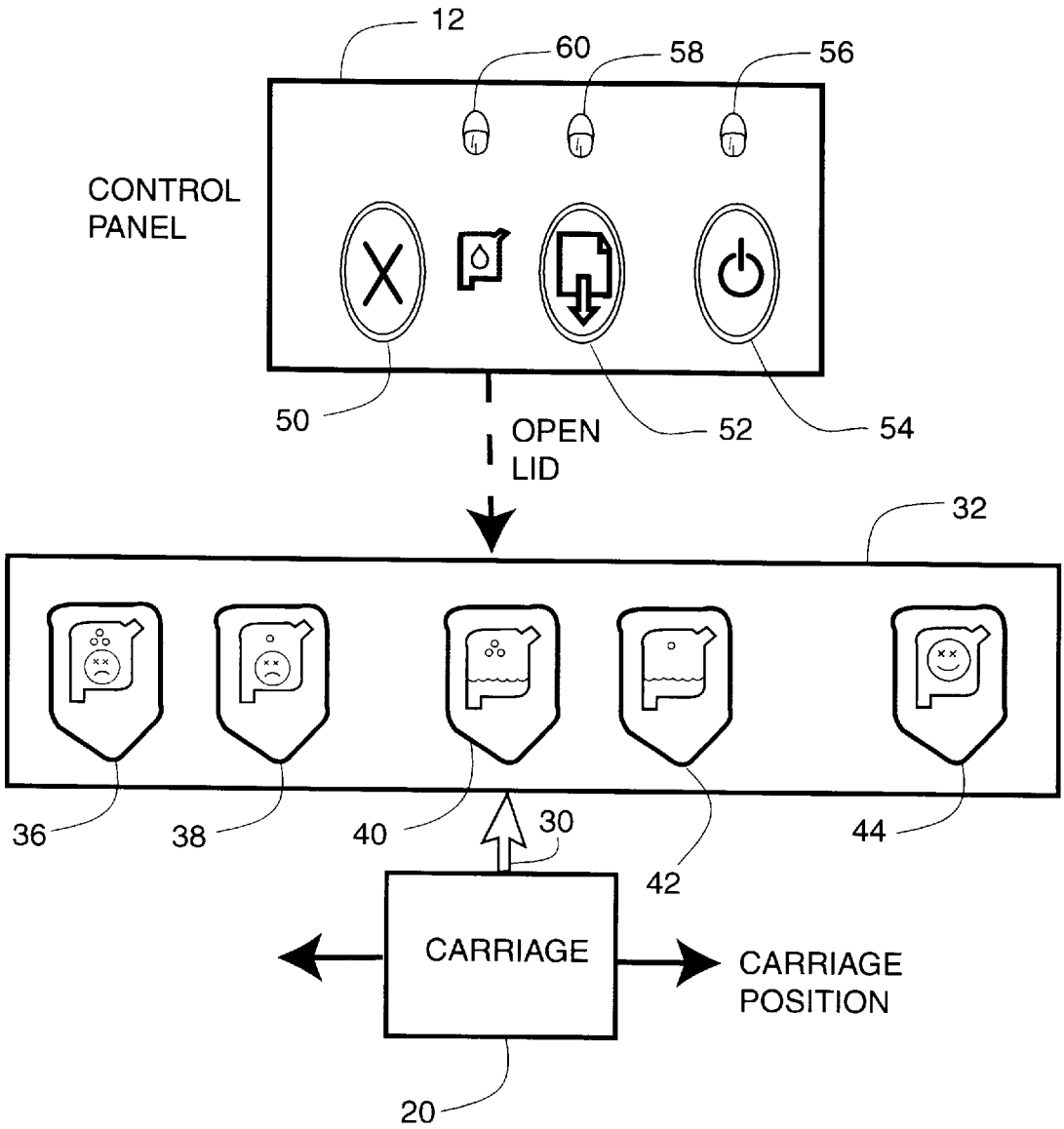
FIG. 4 is a diagram illustrating the process of using the carriage and icons to determine the printer status.

FIG. 4 is a diagram illustrating the process of using the carriage 20 and the set of icons 32 to allow for visual determination of the printer status. The control panel includes a cancel button 50, a resume button 52, and a power button 54. A power indicator light 56 is illuminated in a steady state to indicate the printer 10 on powered on and in an idle state. The resume indicator light 58 flashes when printing is in progress. A print cartridge status light 60 is illuminated to prompt the user to raise the lid 14 and determine the printer status. When the lid 14 is raised to reveal the carriage 20 and the set of icons 32, the carriage position is controlled by the printer 10 to position the arrow 30 to point to the appropriate icon to visually indicate the printer status.

The set of icons 32 could comprise as few as two different icons to indicate a pen problem versus a low ink problem and still realize the benefits of the present invention. More icons can be added to the set of icons 32 to provide further information as to which pen, either the black pen 22 or the color pen 24, is having the problem or to include other aspects of printer status such as print quality or data errors.

Figure 5:
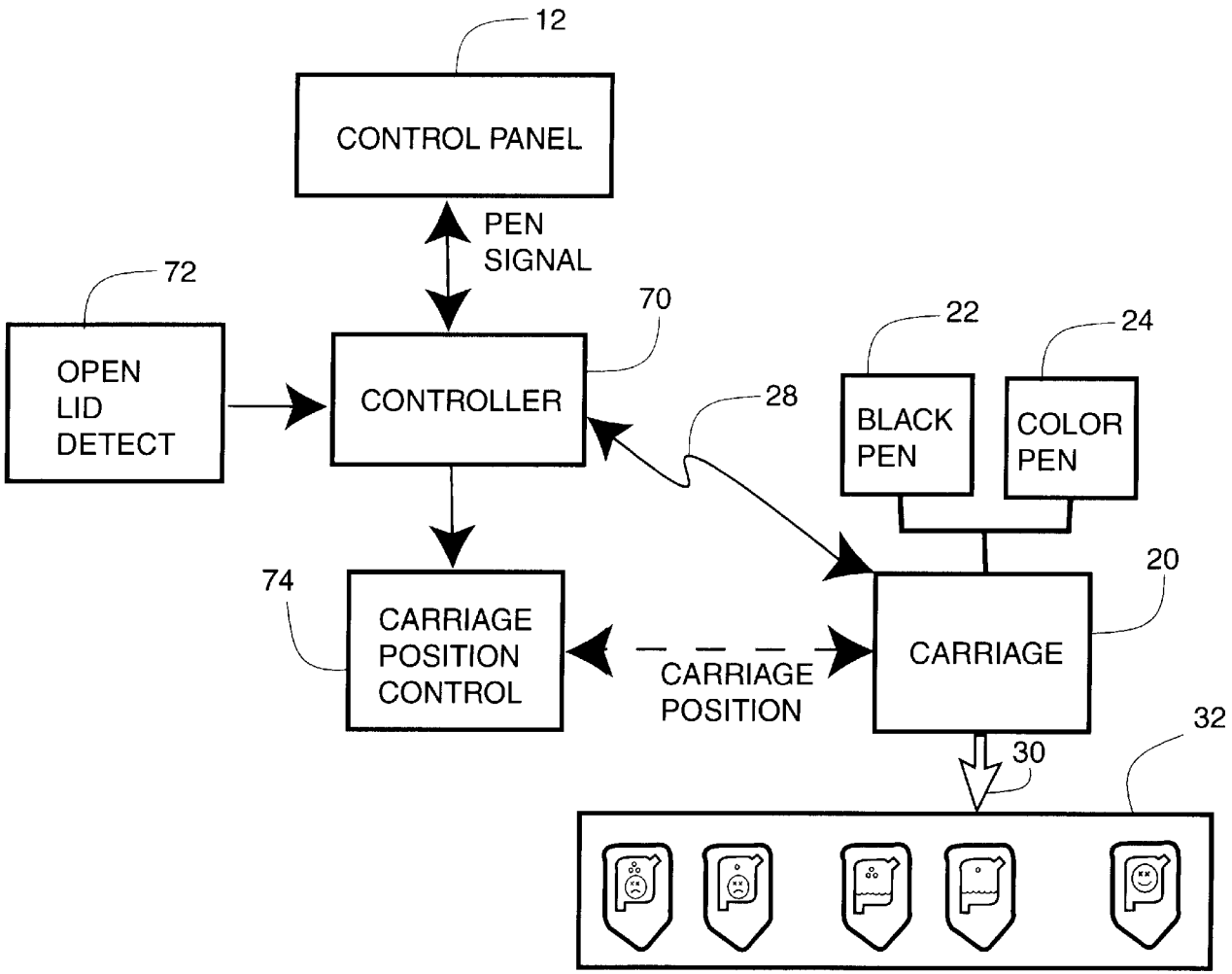
FIG. 5 is a block diagram of a portion of the printer of FIG. 1 to provide the indication of printer status.

FIG. 5 is a block diagram of a portion of the printer 10 that provides for the indication of printer status according to the present invention. A controller 70 controls the overall operation of the printer 10 and may be implemented in the form of a microprocessor or embedded controller according to design requirements. A lid detect 72 operates as a sensor to detect whether the lid 14 is in the open or closed position and provides a signal to the controller 70. The lid detect 72 could be implemented with a mechanical switch, magnetic reed switch, optical sensor, or any of a variety of other technologies readily available to detect mechanical position. The control panel 12 is coupled to the controller 70 to provide input from the cancel button 50, the resume button 52, and the power button 54 and receive signals to drive the power indicator light 56, the resume indicator light 58, and the print cartridge status light 60.

The controller 70 communicates with the black pen 22 and the color pen 24 via the ribbon cable 28 and the carriage 20, both to transmit print data during normal printing operations and to receive back pen status information such as ink supply levels and operational status. If a problem with the either the black pen 22 or color pen 24 is detected by the controller 70, the print cartridge status light 60 is illuminated to prompt the user to lift the lid 14 and correct the problem. Responsive to a signal from the open lid detect 72, the controller 70 sends a signal to the carriage position control 74 to position the carriage 20 so that the arrow 30 points to the appropriate icon in the set of icons 32 to visually indicate the printer status. The carriage position control 74 may comprise a stepper motor and associated drive electronics (not shown) that move the carriage to a carriage position along the guide rod 26. The carriage position chosen corresponds to the position that allows visual indication of the printer status from the set of icons 32, the carriage 20 and the arrow 30. In this way, the printer status is visually represented to the user in order to more easily diagnose and correct problems detected by the controller 70.

It will be obvious to those having ordinary skill in the art that many changes may be made in the details of the above-described preferred embodiments of the invention without departing from the spirit of the invention in its broader aspects. For example, other forms of printer status information such as over-temperature conditions, data error conditions, or degraded print quality problems could be detected and displayed according to an appropriate icon. Printer technologies other than thermal inkjet that include a moving carriage may also benefit from the present invention. Therefore, the scope of the present invention should be determined by the following claims.

What we claim as our invention is:

1. A status indication apparatus for a printer comprising:

a carriage;

at least one pen mounted in said carriage;

a controller coupled to said pen to determine a printer status and to said carriage to set a carriage position; and a set of icons located adjacent to said carriage wherein said carriage position is set so that said carriage indicates one of said set of icons corresponding to said printer status;

wherein the printer status is selected from a set of printer status conditions;

said controller being operated to set the carriage at a position selected from a set of carriage positions, each corresponding to a printer status condition and indicated by one of said set of icons.

2. A status indication apparatus for a printer according to claim 1 further comprising:

a lid having an open position and a closed position; and an open lid detect wherein said open lid detect sends a signal to said controller when said lid is in said open position.

3. A status indication apparatus for a printer according to claim 1 further comprising a print cartridge status indicator.

4. A status indication apparatus for a printer according to claim 3 wherein said print cartridge status indicator is illuminated to provide a prompt to raise said lid.

5. A status indication apparatus for a printer according to claim 1 further comprising a carriage position control interposed between said controller and said carriage for determining said carriage position.

6. A status indication apparatus for a printer according to claim 1 wherein said set of icons is molded into a top surface of said printer.

7. A status indication apparatus for a printer according to claim 1 wherein said carriage further comprises an arrow for pointing to said one of said set of icons.

8. A status indication apparatus for a printer according to claim 1 further comprising a plurality of pens mounted in said carriage wherein said set of icons indicates said printer status for each of said plurality of pens.

9. A status indication apparatus for a printer according to claim 1 wherein said printer comprises an inkjet printer.

10. A method of indicating printer status in a printer having a movable carriage, comprising the steps:

determining a printer status;

moving the carriage to a position corresponding to the status; and wherein the printer has a plurality of visible elements, each having a meaning corresponding to a selected printer status, and wherein the step of moving the carriage includes moving the carriage to a position adjacent the visible element having a meaning corresponding to the printer status.

11. The method of claim 10 wherein the carriage and visible elements are concealed behind a lid, and wherein moving the carriage occurs in response to opening the lid.

* * * * *